United States Patent [19]

Vinson et al.

[11] 4,149,576

[45] Apr. 17, 1979

[54] APPARATUS FOR LOADING COMPRESSIBLE FLUIDS INTO CARTRIDGES

[75] Inventors: Donald R. Vinson, Tamaqua; Bernard J. Dargay, Milnesville, both of Pa.

[73] Assignee: Atlas Powder Company, Tamaqua, Pa.

[21] Appl. No.: 848,654

[22] Filed: Nov. 4, 1977

[51] Int. Cl.[2] ..... B65B 3/04

[52] U.S. Cl. ..... 141/392; 74/55; 222/509; 251/80

[58] Field of Search ..... 141/392; 222/505, 508, 222/509, 559; 74/55; 251/80, 318, 319, 294

[56] References Cited

U.S. PATENT DOCUMENTS

| | | | |
|---|---|---|---|
| 653,750 | 7/1900 | Marcellus | 222/509 |
| 1,506,577 | 8/1924 | George | 251/294 |

*Primary Examiner*—Houston S. Bell, Jr.

*Attorney, Agent, or Firm*—Richards, Harris & Medlock

[57] ABSTRACT

A system for loading a predetermined quantity of a compressible fluid into tubular cartridges or the like is provided which includes filling apparatus having filler tubes with ball valve means adjacent the outlet thereof, the outlets comprising flow constricting means for receiving the ball valve means and further including automatic means for opening and closing the ball valve means after a predetermined quantity of compressible fluid has been delivered to the tubular cartridges through the filler tube.

12 Claims, 3 Drawing Figures

APPARATUS FOR LOADING COMPRESSIBLE FLUIDS INTO CARTRIDGES

BACKGROUND OF THE INVENTION

In one aspect, the present invention relates to a method for packaging compressible fluids in predetermined quantities in tubular cartridges or the like. In another aspect, this invention relates to an apparatus for use with a cartridge loading mechanism which loads compressible, gas containing, gel compositions into cartridges and provides for accurate metering of such gel compositions into the cartridge packages. In still another aspect, this invention relates to the packaging of gelled explosive compositions, which are compressible in nature because of entrapped air or other gases, and which are packaged in tubular cartridges filled with filling tubes to which a predetermined amount of gel explosive composition is delivered via a piston feed apparatus.

Handling and packaging of viscous liquid compositions which are compressible because of the presence of entrapped gases therein presents problems which are unique because of the physical characteristics of the material. When gelled fluid materials containing entrapped gases are packaged in individual containers for use by consumers, it is conventional to deliver such fluids to the packages via elongated conduit filler tubes through which the gelled fluid is forced under pressure. One means for delivering such gelled fluids to containers in predetermined, closely metered, quantities is to use a piston cylinder arrangement. In such a filling apparatus a cylinder is first allowed to communicate with a reservoir of the gel fluid material, the piston is withdrawn within the cylinder so as to create a suction and thereby fill the cylinder with the gel fluid, the cylinder then is disconnected from the reservoir of gel fluid and the outlet of the cylinder is directed to filler tubes and the piston plunged downward through the cylinder thereby delivering a predetermined quantity of gel-type fluid out of the cylinder, through the filler tubes and into the packages which can comprises, for example, cardboard, paper or plastic cartridges.

In the packaging of gel-type explosive compositions which have been sensitized by incorporating therein occluded air or other gases, delivery of the explosive compositions to paper cartridges via a filler system such as that described above presents unique problems because of the high compressibility of the gel explosive compositions. This high compressibility is a direct result of the fact that the gel explosive compositions are sensitized (so as to be more easily detonable) by admixing therewith air, or other gases, and entrapping the gases within the gel by providing enough guar gum or the like so that the occluded gases will stay dispersed within the gel explosive composition and will not coalesce and separate out of the explosive composition. A consequence of the high compressibility of such gel explosive compositions is that when they are packaged the presence of occluded gases causes the explosive gels to become highly compressed when pumped through the filler tube and into the cartridges via a pressure source such as the filler piston-cylinder arrangement described above. The residual portion of explosive composition which is left behind in the filler tube, after the predetermined amount has been delivered to the cartridge packages is, of course, desirable so that when the next cartridge is filled a steady stream of explosive composition will be delivered thereto with no air pockets separating the residual explosive composition in the filler tube from the delivered to the filler tube from the pressurized delivery source. In the past, however, the compressibility of the gel explosive compositions has caused problems in that once the pressure from the pressurized filler source is relieved, and the filler tube removed from the cartridge being filled, the remaining portion of the explosive gel contained within the filler tube will no longer be subjected to pressures sufficient to keep it in a compressed state. Thus, the explosive composition contained within the filler tube will tend to expand, causing the gel explosive composition to leak or dribble from the open end of the filler tube. Such loss of explosive gel compositions is both expensive and hazardous and is, therefore, very undesirable. Furthermore, when the gel explosive compositions are being packaged in cardboard cartridges or the like, excess explosive gel materials dripping from the filler tube is undesirable in that it will contaminate the outside of such cartridges and washing such excess off with water may cause some damage to the containers.

Another problem associated with the packaging of explosive gel compositions is blockage and/or valve damage which may occur if solid lumps of material are present in the composition being delivered under pressure through filler tubes to packaging containers. For example, undissolved lumps of guar gum, conventionally used to thicken gel explosive compositions, may cause blockage or damage at constricting valve sites within the loading apparatus.

Thus, it is desirable to have a method and apparatus for loading compressible gel type fluids containing entrapped gases into containers therefor in predetermined quantities wherein the problems caused by the expansion of such fluids between filling cycles, and the presence of solid particles in the composition, are alleviated.

SUMMARY OF THE INVENTION

The present invention provides for an apparatus and method for filling paper, plastic or cardboard cartridges, and the like, with gel-type compressible fluids containing entrapped gases whereby the problems described above with relation to leakage of excess gel fluids from the filler tube apparatus of a filling mechanism are overcome. Further, the apparatus of the present invention minimizes breakage and clogging problems due to solid particles present in the composition being loaded. Generally, the present invention relates to an improvement in a filling apparatus useful in loading compressible gel type explosive compositions and other types of compressible liquid gels containing entrapped gases into tubular cartridge packages and the like. The filling apparatus can comprise a piston load feed assembly for delivering measured quantities of the compressible fluid through filler tubes and into the tubular packages wherein a ball valve means is provided adjacent the outlet of the filler tubes, the outlets of the filler tubes having flow constricting means for receiving the ball valve means. The present invention provides automatic means for opening and closing the ball valve means located adjacent the tip of the filler tubes after a predetermined quantity of the gel explosive composition, or other compressible gel-type fluid, has been delivered into the tubular package through the filler tube.

More specifically, the present invention provides a tip valve assembly for use with cartridge loading apparatus for compressible gel explosive compositions having elongated filler tubes which comprises a flow constriction means having a circular aperture therethrough adjacent the outlet end of the filler tubes, a ball valve means of slightly smaller diameter than the aperture of the valve seat, flexible valve stem means affixed to the ball valve means and extending longitudinally through the length of the filler tube, and means for moving the ball valve means and valve stem means longitudinally along the length of the filler tube, from an open position within the filler tube, to a closed position therein, wherein the ball valve is inserted into the flow constriction means to thereby arrest the flow of material from the outlet end of the filler tube.

In another aspect the present invention provides an apparatus for automatically opening and closing a plurality of tip ball valves located in filler tubes so that a multiple number of filler tubes can be employed simultaneously to fill a multiple of cartridges with gel explosive compositions. The ball valve tip assemblies of the present invention provide for automatic sealing of the filler tubes after a predetermined portion of the compressible gel fluid has been deposited in the containers.

DETAILED DESCRIPTION OF THE INVENTION

Figure 1:
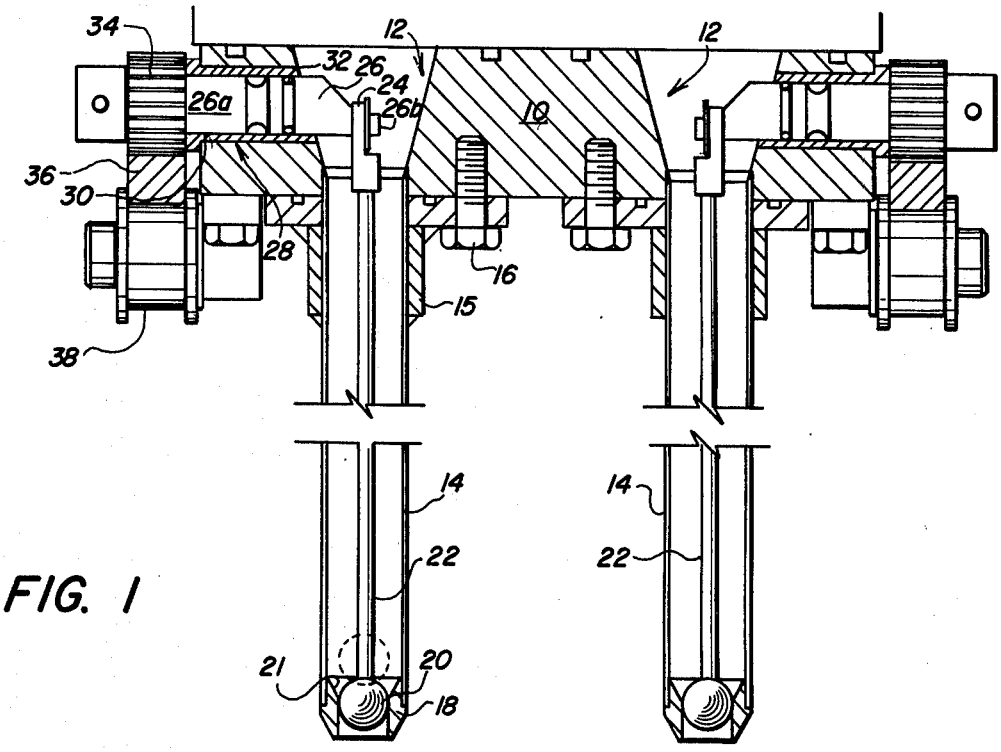
FIG. 1 depicts a cross-sectional view of a pair of filler tubes having the ball valve assembly of the present invention located therein.

The process and apparatus of the present invention which provides for the packaging of gel-type fluids which are compressible in nature because of entrapped gases therein will be hereinafter described in relation to a multiple filler tube assembly useful in the loading of gel-type explosive compositions containing occluded gases as a sensitizer, into tubular cartridges manufactured from cardboard, paper, plastic, or other materials. Of course, the method and apparatus of the present invention can be modified as dictated by the flow characteristics of any particular compressible gel-type fluid and can be employed with a single filler tube as well as with a multiple of filler tubes.

In the loading of gel-type explosive compositions into cardboard cartridges and the like, it is highly desirable that a predetermined amount of the explosive composition be delivered automatically to a cartridge or other container having a known volume so that the cartridge or container will be completely filled (that is, will not have any air gaps present therein) but will not be overfilled, causing unnecessary waste and, in the handling of explosives, a safety hazard. Complete filling of the tubular cartridges in which gel explosives are conventionally sold is necessary not only in order to insure that the specified amount of explosive is actually contained within the cartridge but also because any air gaps or spaces within the cartridge may affect its detonation characteristics adversely. Therefore, when filling paper tubular cartridges, or the like, especially those of small diameters of below about 2", for example, it has been found that inserting the filler tube of a filling apparatus to the bottom of the cartridge and delivering the explosive composition into the cartridge as the filler tubes are lifted out of the cartridge (or the cartridge dropped away from the filler tube) provides for a method of insuring that the cartridge is completely filled with the gel explosive composition without any air gaps which might arise should the gel explosive composition merely be dropped into the top end of a cartridge of fairly small diameter.

Thus, in conventional small diameter cartridge packaging operations for gel explosive compositions a filler tube, or multiple of filler tubes, is inserted into the empty cartridges either by moving the cartridges up to a stationary filler tube apparatus, or by providing a movable filler apparatus which will lower the filler tubes into the cartridges. Once the outlet ends of the filler tubes are at the bottom of the tubular cartridges the filling apparatus begins to deliver a predetermined amount of gel explosive composition to the cartridges as the cartridge and filler tubes separate so that when the cartridges have been filled with the predetermined amount of explosive composition the pressure forcing the explosive composition out of the filler tubes is arrested, thereby substantially stopping all of the flow of the explosive gel into the cartridges. However, as noted above, the reduction in pressure (upon stopping the flow of compressible fluid through the filler tube) allows the compressible fluid to expand such that a significant amount of material may drip or ooze from the end of the filler tubes, thus providing an unwanted excess of material. According to the present invention, such excess is avoided by providing a ball valve means cooperating with a flow constricting means at the tip of the filler tube so as to effectively close the tip of the filler tube once the predetermined amount of compressible gel fluid has been delivered to the package.

Referring to FIG. 1, a preferred embodiment of the subject invention is presented which comprises an apparatus useful in combination with a pressure delivery source, such as a piston-cylinder arrangement, for delivery of compressible air or gas containing gel-type fluids for placement in tubular cartridges and in similar packages. Thus, manifold block 10 comprises a series of conical apertures therethrough 12 to which a gas containing, gel-type fluid is delivered. Communicating with conical manifold apertures 12 are elongated filler tubes 14 which can be conveniently mounted on manifold block 10 via mounting brackets 15 and threaded screws 16. At the tip of filler tube 14 a flow constricting member 18 is provided which reduces the inner diameter of the filler tubes 14 adjacent the outlet thereof. Flow constricting member 18 can (as shown in FIG. 1) comprise an annular insert secured inside the outlet end of filler tube 14 or, in the alternative, the outlet end of filler tube 14 can be fabricated so as to include annular flow constricting member 18. Ball valve member 20 is located adjacent flow constricting member 18 and is of a diameter slightly smaller than the diameter of the aperture formed by flow constricting member 18. Thus, as depicted in FIG. 1, when ball valve member 20 is in a closed position, it is inserted within flow constricting member 18, thereby arresting the passage of any compressible gas containing gel-type fluids from the tip of filler tube 14. Generally, it has been found that when such apparatus is employed with explosive gel compositions a ball valve member 20 having a diameter of from about 0.001 to about 0.004 inches less than the inner diameter of flow constricting means 18 can be used and that such an arrangement will arrest flow of the gel material from the tip of filler tubes 14.

This arrangement, whereby the ball valve member 20 cooperates with flow constricting means 18 to arrest the flow of a compressible gel-type fluid from filler tubes 14 is specifically designed to resist blockage or valve damage occasioned by the presence of lumps or particles in the fluid being delivered by the apparatus. Thus, when ball valve member 20 is in an open position (as depicted in dotted lines in FIG. 1) the annular clearance between the ball valve member 20 and the inner diameter of the filler tube 14 is less than the clearance between the ball valve 20 and the conical guiding surface 21 of flow constricting member 18. Therefore, any lump or solid particle which can pass between ball valve member 20 and the inside wall of of filler tube 14 can also pass between ball valve member 18 and conical guiding surface 21 of flow constricting means 20.

Ball valve member 20 is firmly affixed to valve stem member 22 which can comprise an elongated shaft running axially through filler tube 14. The application of ball valve member 20 to valve stem member 22 can be conveniently accomplished by threading the end of valve stem member 22 and securing it into a threaded aperture in ball valve member 20 and securing the joint with solder. At the upper end of valve stem member 22, drive attachment means 24 is provided which has an aperture therethrough for receiving eccentric shaft 26. Thus, as eccentric shaft 26 is rotated about the axis of the larger diameter shaft portion 26*a* thereof, the axis of the smaller diameter shaft portion 26*b* carries drive attachment means 24 up and down around a circular path, thereby providing for the closed relationship of ball valve 20 within flow constricting member 18, as shown in FIG. 1, as well as an open relationship thereof (shown in dotted lines). Further protection against clogging or valve damage is provided by the flexible nature of the valve stem member 22 and drive attachment means 24. Thus, if a large lumps of solid material enters filler tube 14 the flexibility of valve stem member 22 will allow ball valve member 20 to be forced aside and the solid lump to pass through filler tube 14. Furthermore, the valve tip assembly of the present invention can continue to operate even if valve stem member 22 becomes bent, so long as ball valve member 20 can enter the constricting diameter of flow constricting member 18 with the assistance of conical guiding surface 21 thereof. The flexibility described above is provided by the fact that the relatively small diameter of valve stem member 22 with respect to its length allow substantial flexibility when materials such as, for example, stainless steel are employed to fabricate the valve stem member. Furthermore, the rotational attachment of drive attachment means 24 to small diameter shaft portion 26*b* provides flexible movement of valve stem member 22 within filler tube 14 in a plane perpendicular to that of the cross section depicted in FIG. 1. Some flexibility is also obtained from the play between the small shaft portion 26*a* and the aperture in drive attachment means 24, through which it extends.

Eccentric shaft 26 extends through an aperture 28 in the manifold block 10 and can have bearing means 30 provided for better fit and ease of rotation. O-ring sealing means 32 can be provided around eccentric shaft 26 so as to protect against loss of compressible gel-type fluid which is in contact with that portion of eccentric shaft 26 which extends into aperture 12, to which the fluid is delivered under pressure. Gear means 34 is provided about that portion of eccentric shaft 26 located on the outside of manifold block 10 and is affixed thereto such that rotation of said gear means 34 causes rotation of eccentric shaft 26, thereby operating the ball valve means 20 between open and closed positions. Hence, operation of ball valve means 20 can be accomplished by providing rack shaft 36 (shown in cross-section in FIG. 1) having teeth on the upper surface thereof which mesh with the teeth of gear means 34. Rack shaft 36 can be conveniently held in position by roller guide means 38. Thus, by providing a drive source for moving rack shaft 36 in a longitudinal direction along the axis thereof, gear means 34 will rotate eccentric shaft 26 causing ball valve means 20 to operate between a closed and opened position with respect to flow constricting member 18.

Figure 3:
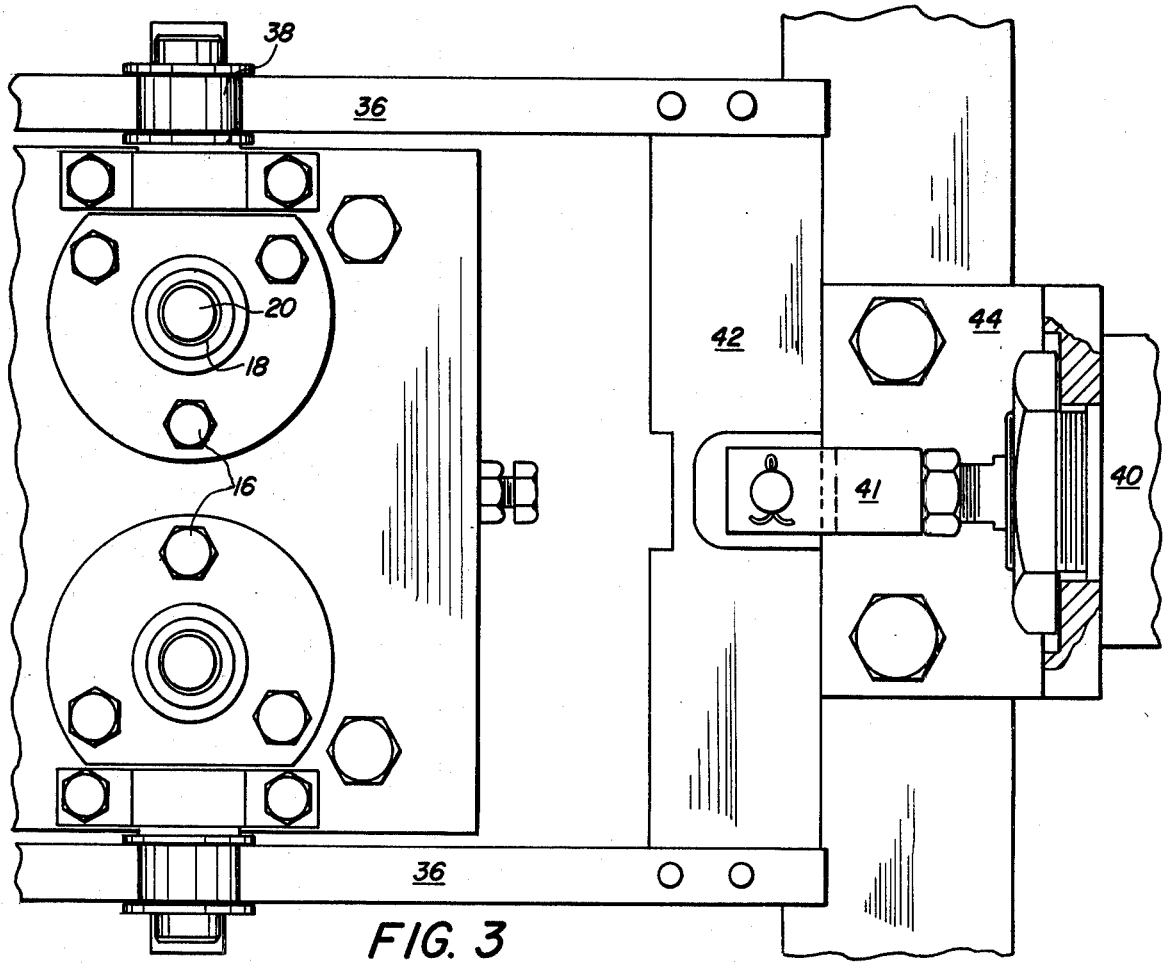
FIG. 3 is a partial bottom view of the multiple filler tube apparatus of FIG. 2.
Figure 2:
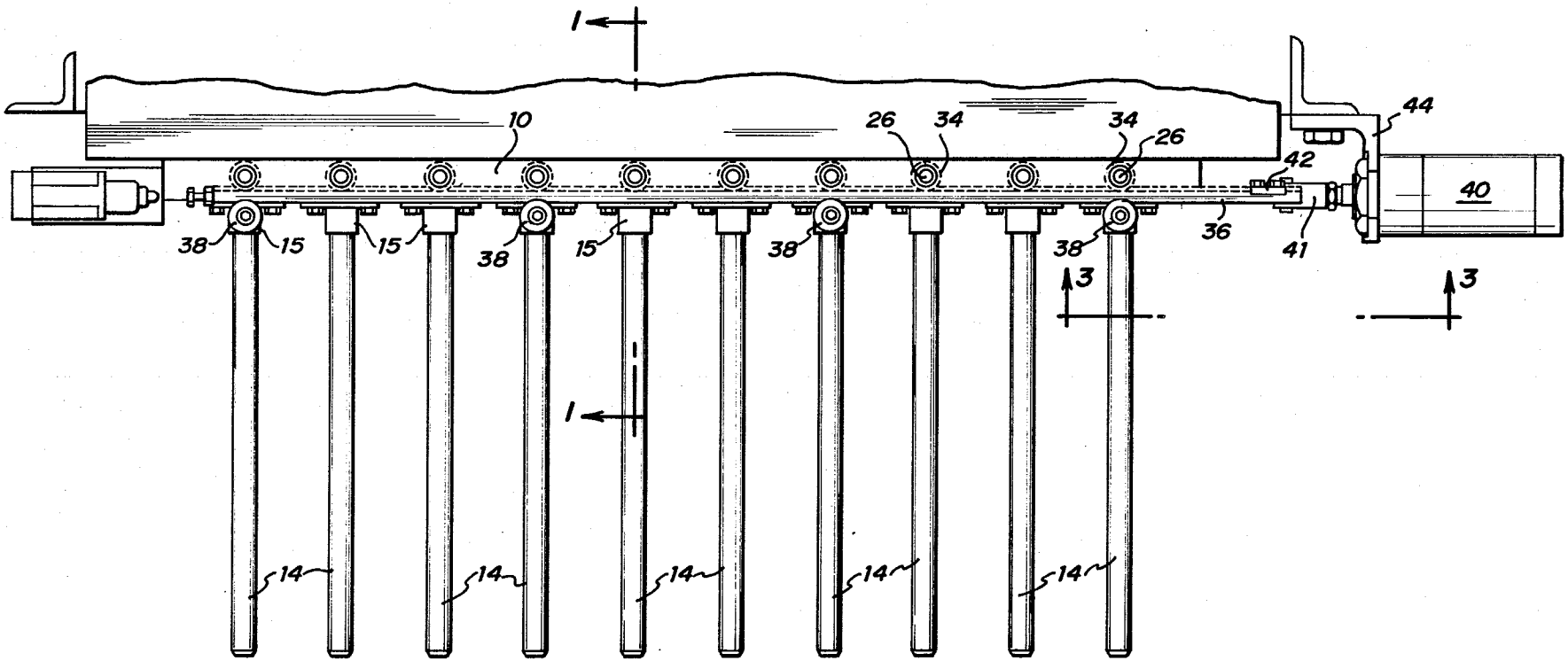
FIG. 2 is a side view of a multiple filler tube apparatus employing a single cylinder to automatically operate the ball tip valves of the present invention located in each of the filler tubes.

Now referring to FIGS. 2 and 3, a filling apparatus useful in filling paper cartridges with gel explosive compositions containing occluded gases which are highly compressible is depicted. A series of filler tubes 14 are shown connected via mounting brackets 15 to a manifold block 10; rack shaft 36 is shown resting on roller guide means 38 with the teeth thereof meshing with the teeth of gear means 34 located about the outer end of eccentric shaft means 26. Drive cylinder 40 is provided with the drive shaft 41 thereof affixed to rack shaft mounting plate 42 which transmits longitudinal action to rack shaft 36. The drive cylinder 40 is conveniently affixed to the filling assembly via bracket means 44.

Thus, upon an automatic command, synchronized with the pressure source delivering a predetermined quantity of gel explosive materials to filler tubes 14, drive cylinder 40 may be activated such that its drive shaft 41 forces rack shaft mounting plate 42 forward causing the teeth of rack shaft 36 to rotate gear means 34, thereby moving valve stem member 22 in a circular path downward causing ball valve means 20 to move into a closed position within flow constricting member 18. In this manner once a predetermined amount of explosive gel has been delivered to the packing cartridge, drive piston 40 can be either manually or automatically operated so as to effectively seal-off the tip of filler tubes 14 to the extent necessary to prevent any of the compressible gel-type fluids from dripping or leaking therefrom once the pressure source delivering the gel-type fluid to the filler tubes is relieved. An example of the operation of the apparatus of the present invention, when used in conjunction with a cylinder, piston feed assembly, can be described as follows:

(a) Ball valve member 20 is lifted from a closed position within flow constricting member 18 by valve stem member 22, via rotation of eccentric shaft 26;

(b) The discharge valves of a piston, cylinder feed apparatus are operated so as to communicate with conical manifold apertures 12. Because manifold block 10 and filler tubes 14 contain gel-type explosive composition from a previous cycle some material may start to ooze from the tips of filler tubes 14, however, at this point in the operation the filler tubes 14 are inserted in the cartridge or other containers which are to be filled;

(c) The piston, cylinder feed apparatus is operated so as to begin its feed stroke and push a quantity of gel explosive into conical manifold aperture 12;

(d) The flow path of gel explosive composition through conical manifold aperture 12, around eccentric shaft 26, down through filler tube 14 and around ball valve member 20 is such that considerable back pressure develops and the gel explosive composition is compressed between flow constricting member 18 and the piston head of the feed assembly;

(e) As the piston continues its feed stroke the pressure developed thereby overcomes the above described back pressure and the gel explosive composition flows through flow constricting member 18 and out the tip of filler tubes 14. The cartridges which are being loaded begin to descend away from the outlet of filler tube 14 at rates matching the rising slurry level;

(f) At the end of the filling stroke the cartridge will be substantially full of gel explosive composition and the flow of gel composition from the tip of filler tubes 14 will slow as the back pressure created by the flow path begins to match the decreasing pressure;

(g) As the flow of gel explosive reduces to a dribble, ball valve member 20 is moved to a closed position within flow constricting member 18 thus arresting any further flow from the tip of filler tubes 14.

Thus, with respect to the multiple filler tube arrangement shown in FIGS. 2 and 3, once a new cartridge or set of cartridges have been positioned under filler tubes 14, the pressurized fluid source will again deliver explosive gel composition to filler tubes 14 via aperture 12 and manifold block 10, and cylinder 40 is, therefore, operated in reverse to thereby cause the rack shaft 36 to move backward, reversing the rotation of gear 34, and lifting ball valve means 20 from its closed position within flow constricting member 18. Once the predetermined amount of explosive gel has been deposited in the cartridge-type packages the above closing cycle is repeated, thereby avoiding any loss of explosive gel composition from the end of filler tubes 14 between filling cycles.

While this invention has been described in relation to the preferred embodiments thereof various modifications will now be apparent to those of ordinary skill in the art upon reading the specification and it is intended to cover all such modifications which fall within the scope of the appended claims.

What is claimed is:

1. A filling apparatus for delivering compressible, gas containing, gel-type fluids to packaging containers comprising:

(a) elongated filler tubes for delivery of said fluids to said containers;

(b) means for delivering predetermined quantities of said fluid to said filler tubes under pressure; and (c) tip valve means for arresting the flow of said fluid from the outlet of said filler tubes between filling cycles comprising flow constricting means adjacent said outlet and ball valve means of a diameter slightly smaller than the inside diameter of said flow constricting means, said ball valve means operable between an open position within said filler tubes and a closed position within said flow constricting means;

(d) means for moving said ball valve means between said open position and said closed position.

2. The apparatus of claim 1 wherein said tip valve means further comprises valve stem means affixed to said ball valve means and extending substantially axially within said filler tube.

3. The apparatus of claim 2 wherein said means for moving said ball valve means between an open and a closed position comprises an eccentric shaft, having a large shaft portion and a small shaft portion, said small shaft portion being rotatably affixed to said valve stem means such that upon rotation of said large shaft portion said valve stem means is carried in a circular motion to thereby move said ball valve means between said open and closed positions.

4. The apparatus of claim 3 and further comprising gear means affixed to the large shaft portion of said eccentric shaft.

5. The apparatus of claim 4 and further comprising rack shaft means for engaging said gear means thereby rotating said eccentric shaft in response to longitudinal motion of said rack shaft.

6. The apparatus of claim 5 and further comprising drive cylinder means affixed to said rack shaft means for providing back and forth longitudinal motion to said rack shaft.

7. The apparatus of claim 6 wherein said drive cylinder means is automatically actuated in cooperation with said means for delivering said fluid to said filler tubes such that said drive cylinder causes said valve tip means to close between filling cycles and open during said filling cycles.

8. A tip valve assembly for a gel-type fluid loading apparatus having elongated filler tubes comprising:

(a) a flow constricting means for reducing the inner diameter of said filler tubes adjacent the outlet thereof;

(b) a ball valve means of slightly smaller diameter than the inner diameter of said flow constricting means;

(c) valve stem means affixed to said ball valve means and extending longitudinally along the length of said filler tubes;

(d) means for moving said ball valve means between an open position above said flow constricting means and a closed position within said flow constricting means by providing longitudinal motion to said valve stem means.

9. The tip valve assembly to claim 8 wherein said means for moving said ball valve means between an open and a closed position comprises an eccentric shaft having a large shaft portion and a small shaft portion said small shaft portion interconnected to said valve stem means at a substantially perpendicular angle and in rotatable relationship such that upon rotation of the large shaft portion of said eccentric shaft means said small shaft portion of said eccentric shaft means carries said valve stem means upward and downward in a circular motion thereby moving said ball valve means between said open and said closed position.

10. The tip valve assembly of claim 8 wherein said valve stem means is flexible enough to provide for the passage of solid particles contained by said gel-type fluid.

11. The tip valve assembly of claim 8 wherein the clearance between the inner wall of said filler tube and said ball valve means when said ball valve means is in an open position is less than the clearance between said ball valve means and said flow constricting means when said ball valve means is in an open position.

12. In a filling apparatus for loading compressible explosive compositions containing entrapped gases into packaging cartridges which comprises a piston load feed assembly for delivering measured quantities of said explosives through filler tubes and into said cartridges, the improvement comprising:

tip valve means adjacent the outlet of said filler tubes, said tip valve means comprising a flow constricting means for receiving a ball valve means of a diameter slightly smaller than the inner diameter of said flow constricting means and automatic means for opening and closing said ball valve means after a predetermined quantity of explosive has been delivered to said cartridges through said filler tubes.

* * * * *

UNITED STATES PATENT AND TRADEMARK OFFICE

CERTIFICATE OF CORRECTION

PATENT NO. : 4,149,576

DATED : April 17, 1979

INVENTOR(S) : Donald R. Vinson, et al.

It is certified that error appears in the above-identified patent and that said Letters Patent are hereby corrected as shown below:

Column 2, line 3, change "the" (first occurrence) to --that--.

Column 8, line 34, change "to" to --of--.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*